US008631962B2

(12) United States Patent
Alvares et al.

(10) Patent No.: US 8,631,962 B2
(45) Date of Patent: Jan. 21, 2014

(54) CONTAINER IN METAL SHEET

(75) Inventors: Antonio Carlos Teixeira Alvares, Sao Paulo (BR); Silverio Candido da Cunha, Lajeado (BR)

(73) Assignee: Brasilata S.A. Embalagens Metalicas, Sao Paulo (BR)

( * ) Notice: Subject to any disclaimer, the term of this patent is extended or adjusted under 35 U.S.C. 154(b) by 134 days.

(21) Appl. No.: 12/998,277

(22) PCT Filed: Oct. 8, 2009

(86) PCT No.: PCT/BR2009/000336
§ 371 (c)(1),
(2), (4) Date: May 16, 2011

(87) PCT Pub. No.: WO2010/040196
PCT Pub. Date: Apr. 15, 2010

(65) Prior Publication Data

US 2011/0210129 A1 Sep. 1, 2011

(30) Foreign Application Priority Data

Oct. 9, 2008 (BR) ..... 0804305-1

(51) Int. Cl.
*B65D 6/28* (2006.01)
*B65D 1/42* (2006.01)
*B65D 6/00* (2006.01)

(52) U.S. Cl.
USPC ..... 220/623; 220/634; 220/689

(58) Field of Classification Search
USPC ..... 220/634, 610, 617, 619, 620, 623–625, 220/677–680, 900, 766, 309.1, 672, 790, 220/916, 212.5, 689
See application file for complete search history.

(56) References Cited

U.S. PATENT DOCUMENTS

| | | | | | |
|---|---|---|---|---|---|
| 1,649,292 | A | * | 11/1927 | Draper | 220/672 |
| 3,709,398 | A | * | 1/1973 | Fuhrmann | 220/612 |
| 3,774,560 | A | | 11/1973 | Hartz | 113/120 Y |
| 3,949,877 | A | * | 4/1976 | Santoni | 206/519 |
| 3,987,927 | A | * | 10/1976 | Serr et al. | 220/614 |
| 4,705,184 | A | * | 11/1987 | Tsukamura | 220/619 |
| 5,005,728 | A | * | 4/1991 | Mazurek et al. | 220/619 |
| 5,086,944 | A | * | 2/1992 | Duffy et al. | 220/658 |
| 5,178,297 | A | * | 1/1993 | Harold | 220/612 |

(Continued)

FOREIGN PATENT DOCUMENTS

| | | |
|---|---|---|
| FR | 349 297 | 5/1905 |
| FR | 1 044 841 | 11/1953 |

(Continued)

*Primary Examiner* — Bryon Gehman
*Assistant Examiner* — Shawn Braden
(74) *Attorney, Agent, or Firm* — Harrington & Smith

(57) ABSTRACT

The container includes a peripheral side wall, whose upper peripheral edge defines a retention hook with a profile in the form of an inverted U, having an inner side leg, an arched base leg (lib) and an outer lateral leg (lie). An upper end wall of the container includes a median panel and a peripheral upper skirt having an end edge defining a closure hook with a profile in the form of an inverted U, having an inner side portion, an arched base portion, and an outer side portion which incorporates an upwardly projecting end flange. The closure hook is fitted onto the retention hook and radially inwardly deformed, compressing an elastic sealing element between the two hooks and maintaining the end flange projecting upwardly to the interior of the retention hook.

6 Claims, 12 Drawing Sheets

(56) References Cited

U.S. PATENT DOCUMENTS

| | | | | | |
|---|---|---|---|---|---|
| 5,351,850 | A | * | 10/1994 | Brieskorn | 220/62.18 |
| 5,685,449 | A | * | 11/1997 | Oblak | 220/310.1 |
| 5,878,906 | A | * | 3/1999 | Bolton et al. | 220/309.1 |
| 2011/0168730 | A1 | * | 7/2011 | Alvares et al. | 220/795 |

FOREIGN PATENT DOCUMENTS

| | | | |
|---|---|---|---|
| FR | 2 705 256 | | 11/1994 |
| GB | 2 315 478 | A | 2/1998 |
| WO | WO 03/076282 | A1 | 9/2003 |

* cited by examiner

CONTAINER IN METAL SHEET

FIELD OF THE INVENTION

The present invention refers to a container formed in metal sheet, such as a closed pail or other container comprising a peripheral side wall, with a cylindrical form or an inverted and slightly frusto-conical form and presenting an upper end portion and a lower end portion, to which respective end walls are attached.

PRIOR ART

The containers of the type considered herein have their upper and lower end walls respectively and peripherally double-seamed in the upper end portion and lower end portion of the peripheral side wall, the upper end wall being provided with a generally eccentric opening having a contour substantially smaller than that of the peripheral side wall, and with a gripping handle contained in the interior of the axial projection of the contour of the container, in order to allow the latter to be lifted by the gripping handle attached only on the upper end wall. The opening provided on the upper end wall is configured to define a seat in which is applied a lid generally formed in a plastic material.

Due to the complexity of the double-seaming processes, which require the use of specific and expensive equipment, these double-seaming phases in the manufacture of the container considered herein are rarely carried out in the product filling facilities.

Thus, the containers are closed in the manufacturer's facilities, by double-seaming the end walls to the peripheral side wall of the container, being then shipped to the facilities for filling the product to be commercialized. Since the containers are shipped with the end walls already double-seamed to the peripheral side wall, they cannot be fitted one inside the other, requiring to be arranged side-by-side and stacked in transport vehicles and also in the storage places, both at the container manufacturer and at the filling facilities, requiring a physical space presenting an undesirable large volume in relation to the mass of the material, considerably increasing the shipping and storage costs and requiring special cares to transport these containers.

Another drawback of these containers supplied to the responsible for the filling operation with the end walls already attached, generally by double-seaming, results from the fact that the filling can be only carried out through the opening of reduced dimension provided in the upper end wall. Thus, the time for filling the product is longer than that corresponding to the filling carried out without the upper end wall, as it occurs upon filling containers which are superiorly closed by a removable lid and provided with a suspension handle applied to the peripheral side wall and not to the lid.

SUMMARY OF THE INVENTION

Due to the drawbacks mentioned above, it is an object of the present invention to provide a container in metal sheet, having a peripheral side wall, a lower end wall and an upper end wall provided with a small discharge opening and with a suspension handle and which upper end wall can be easily, quickly, reliably and hermetically affixed to the peripheral side wall by the filler of the product to be packaged, without requiring double-seaming operations.

It is also an object of the present invention to provide a container as mentioned above, whose upper end wall is attached to the peripheral side wall, in order to comply with the safety and hermeticity international rules applied to the metallic containers designed for storing dangerous products.

It is a further object of the present invention to provide a closure arrangement for a container as defined above, which has its peripheral side wall configured to be partially and telescopically fitted in the interior of the peripheral side wall of another container generally disposed under the first container upon stacking.

In order to attain the object mentioned above, the invention proposes a container in metal sheet, of the type which comprises a peripheral side wall having an upper end portion and a lower end portion, to which respective upper and lower end walls are attached.

According to the invention, the upper end portion has a peripheral edge which is bent to define a retention hook with a profile in the form of an inverted U, having an inner lateral leg defined by part of the upper end portion, an arched base leg and an outer lateral leg converging in relation to the inner lateral leg. The upper end wall comprises a median panel and a peripheral upper skirt to be fitted and seated in the interior of the upper end portion and having a end edge which is bent to define a closure hook whose profile has the form of an inverted U, having an inner side portion defined by an upper part of the peripheral upper skirt, an arched base portion and an outer side portion converging in relation to the inner side portion and incorporating, internally, an upwardly projecting end flange, the inner side portion, the arched base portion and the outer side portion of the closure hook being internally and respectively seated against the inner side leg, the arched base leg and the outer lateral leg of the retention hook, with the end flange projecting upwardly to the interior of the retention hook, between the outer side portion and the inner side portion of the latter, and with the arched base leg and the arched base portion compressing an elastic sealing element therebetween.

In order to increase even more the degree of axial retention of the upper end wall, one of the parts defined by the upper end portion and by the peripheral upper skirt of the upper end wall is provided with at least one circumferential retention rib turned to the other of said parts, whilst the other part is provided with a circumferential retention groove defined between two face portions and conformed to be fitted onto the retention rib, upon fitting the upper end wall in the interior of the upper end portion of the peripheral side wall and upon seating of the face portions of said other part against the first of said parts.

The additional axial locking obtained by the mutual engagement of ribs and grooves can be provided with an elastic sealing ring to guarantee the tightness of the upper closure of the container, even in case of impact or fall of the latter.

With the proposed construction, the upper end wall can be fitted and hermetically and reliably affixed to the peripheral side wall, without requiring costly and complex double-seaming operations. Thus, the containers can be manufactured and sent to the filler with the upper end wall still separated from the peripheral side wall and to be affixed thereto by the filler. In this case, the lower end wall can be affixed, by double-seaming, to the respective end portion of the peripheral side wall, by the container manufacturer, before being shipped to the filler.

In the solution proposed herein, the filler can use the whole cross section of one of the end portions, generally the upper, to carry out the filling of the product, reducing the operation time before providing the fitting and retention of the respective end wall in the interior of the peripheral side wall, by means of simple and joint axial and radial compression operations.

In case the peripheral side wall is constructed so as to be tapered from one end portion to the other, generally from the upper end portion to the lower end portion, in a continuous or stepped manner, the containers can be stored and shipped without the upper end wall and in a condition in which they remain partially fitted one inside the other in stacks, allowing a substantial economy in storage and transportation volume until they are closed at the filling facility and, preferably, after the filling operation.

BRIEF DESCRIPTION OF THE DRAWINGS

The invention will be described below, with reference to the enclosed drawings, given by way of example of possible embodiments of the invention and in which.

DETAILED DESCRIPTION OF THE INVENTION

Figure 1:
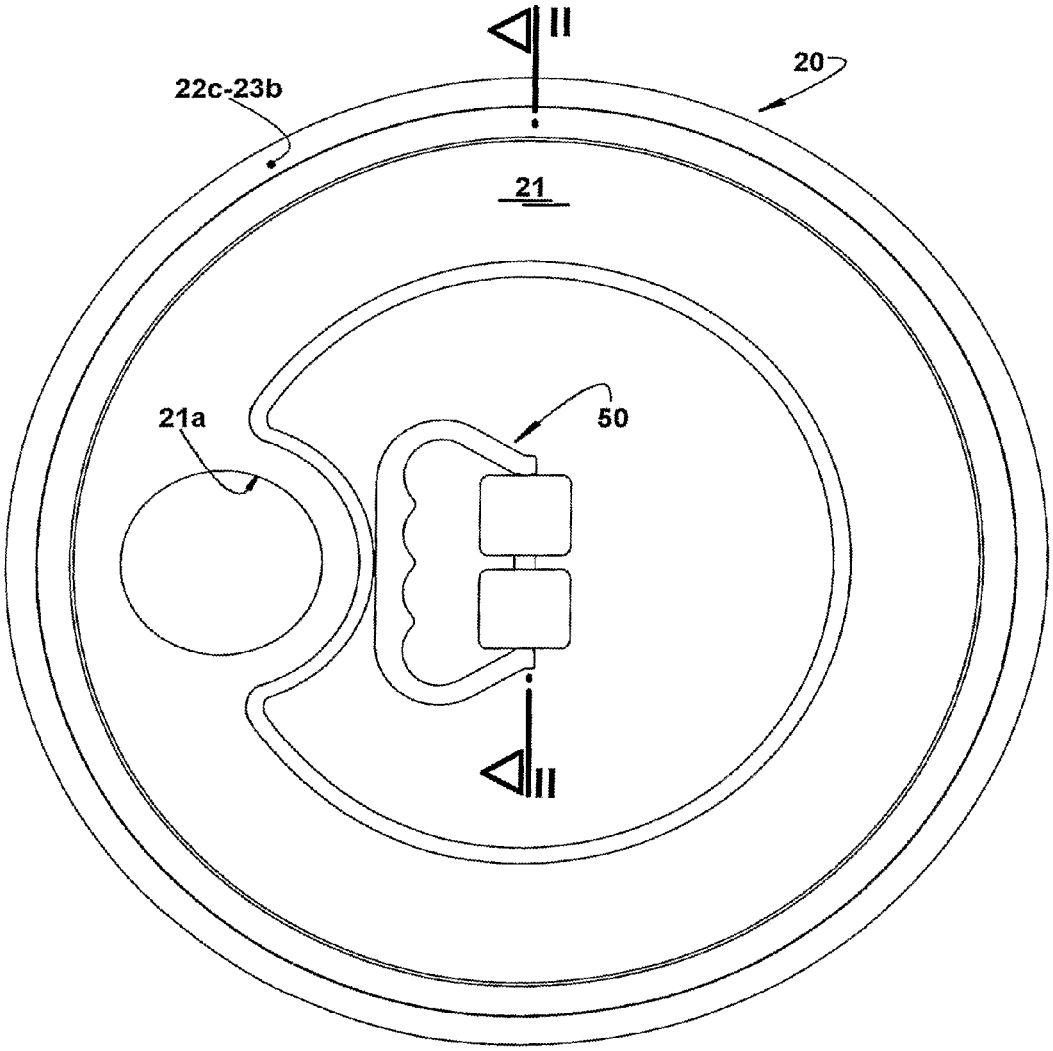
FIG. 1 represents a top plan view of the present container, with its peripheral side wall presenting a circular contour.

The present closure arrangement is applied to a container formed in a metal sheet, usually tinplate, and comprising a peripheral side wall 10, forming a tubular body with any polygonal cross section, usually circular and having an upper end portion 10*a* and a lower end portion 10*b*, in which respective upper end wall 20 and lower end wall 30 are affixed.

According to the drawings, the lower end wall 30 is preferably double-seamed, by the container manufacturer, to the lower end portion 10*b* of the peripheral side wall 10, according to a well known prior art constructive arrangement.

The upper end wall 20 comprises a median panel 21, optionally provided with well known prior art stiffening circumferential ridges and with a peripheral upper skirt 22 projecting axially outwardly and which is configured to be tightly fitted, under interference, in the interior of the upper end portion 10*a* of the peripheral side wall 10.

Figure 2:
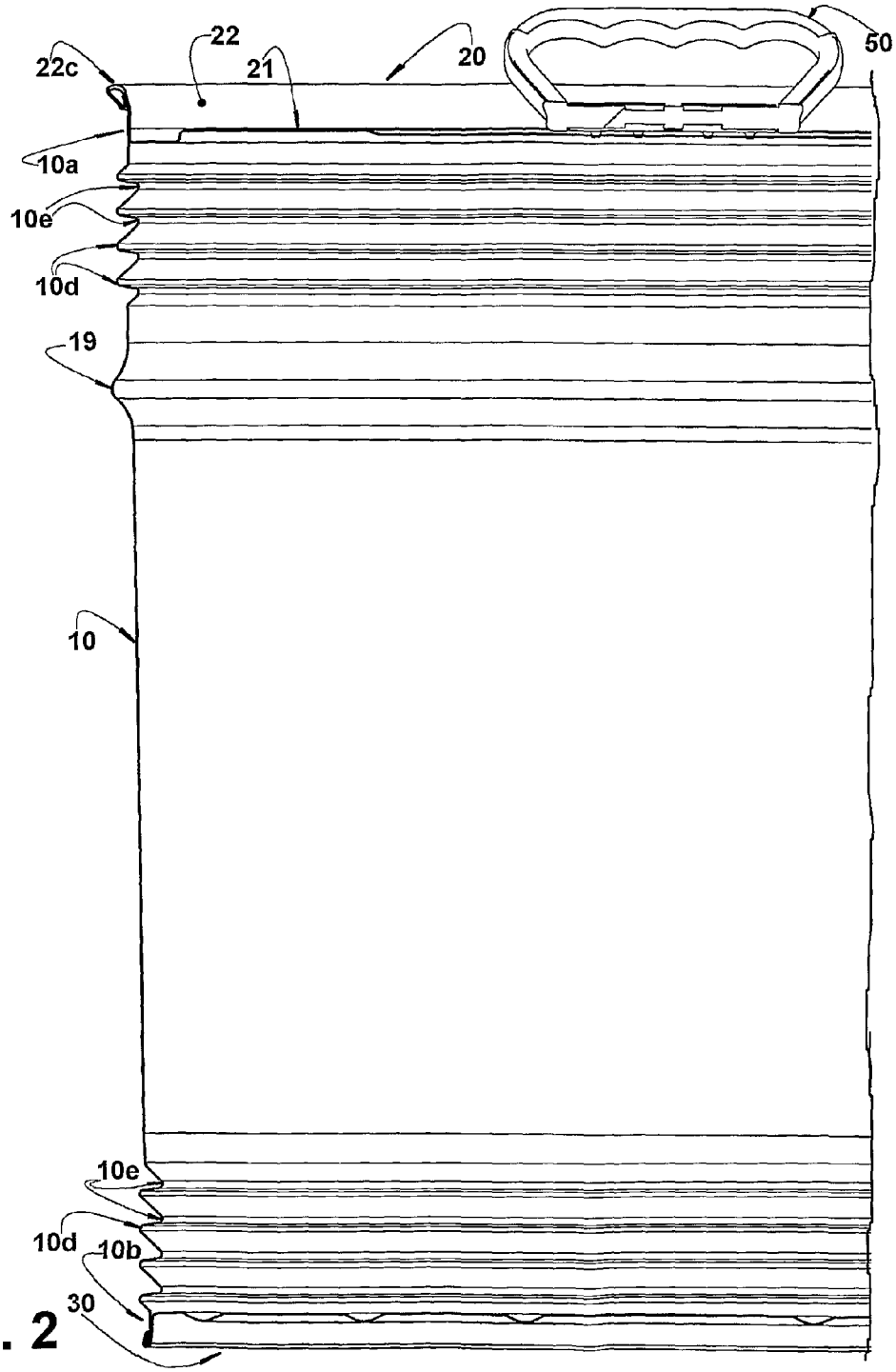
FIG. 2 represents a partial diametrical sectional view of the container, according to a first embodiment and illustrating the upper end wall and lower end wall affixed to the peripheral side wall, said section taken according to line II-II in FIG. 1.
Figure 3A:
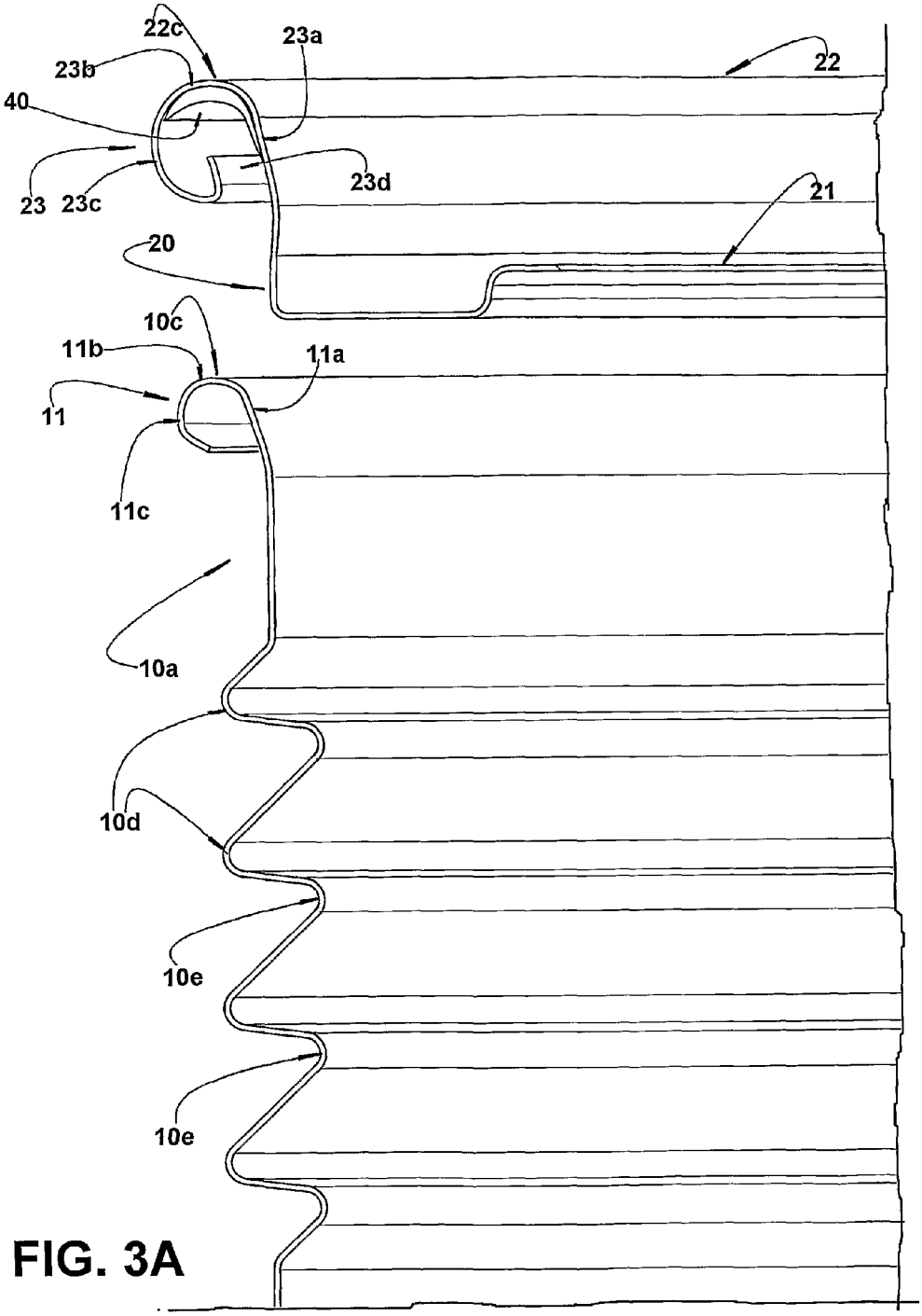
FIG. 3A represents an enlarged exploded detail of the region of FIG. 2, which illustrates the fitting of the upper end wall in the upper end portion of the peripheral side wall, illustrating the form of the component parts before seating the upper end wall onto the peripheral side wall.
Figure 3B:
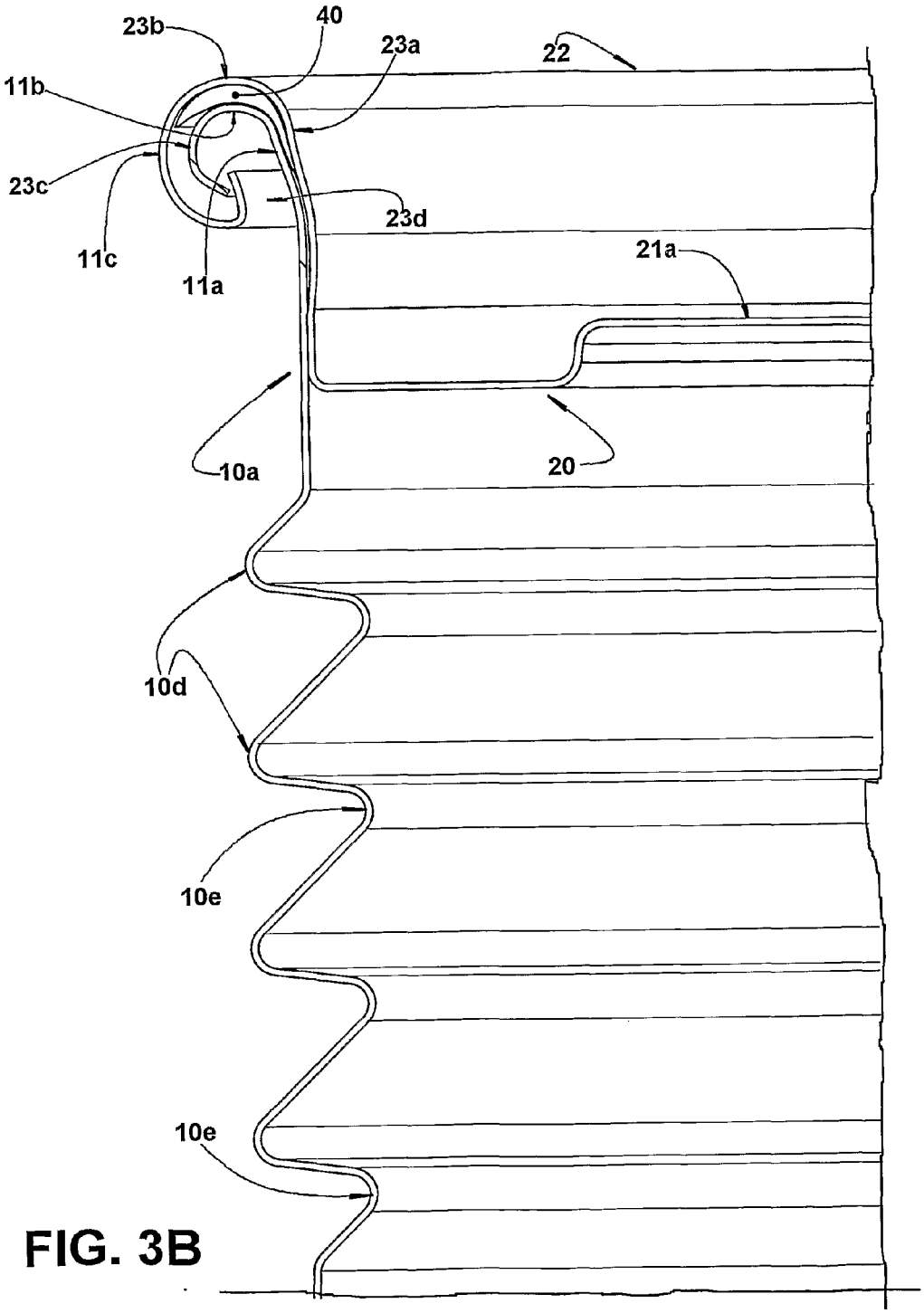
FIG. 3B represents the same detail of FIG. 3A, but illustrating the upper end wall already seated and only provisionally retained in the peripheral side wall.
Figure 3C:
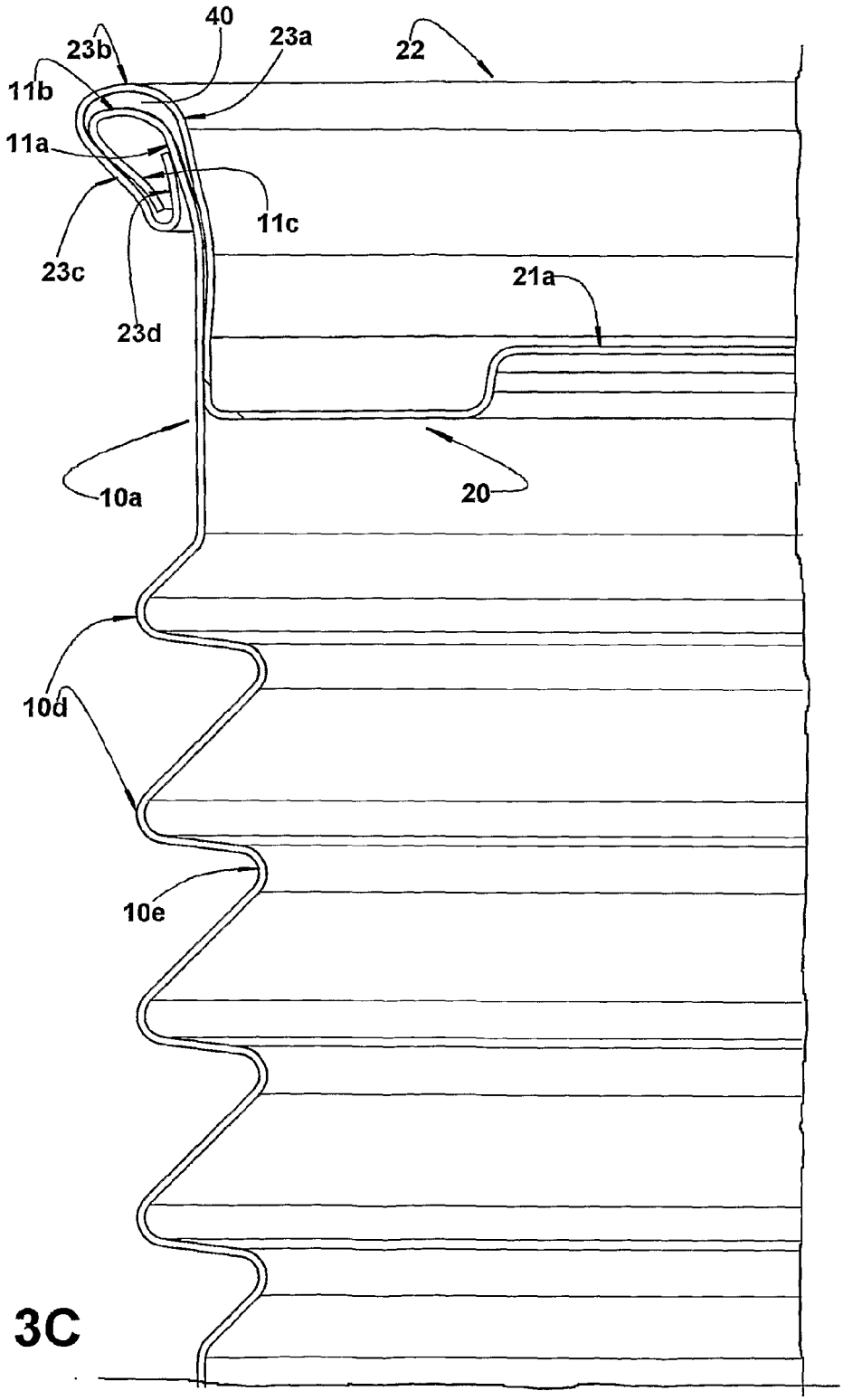
FIG. 3C represents the same detail of FIGS. 3A and 3B, but illustrating the upper end wall already hermetically and strongly seamed in the peripheral side wall.
Figure 4A:
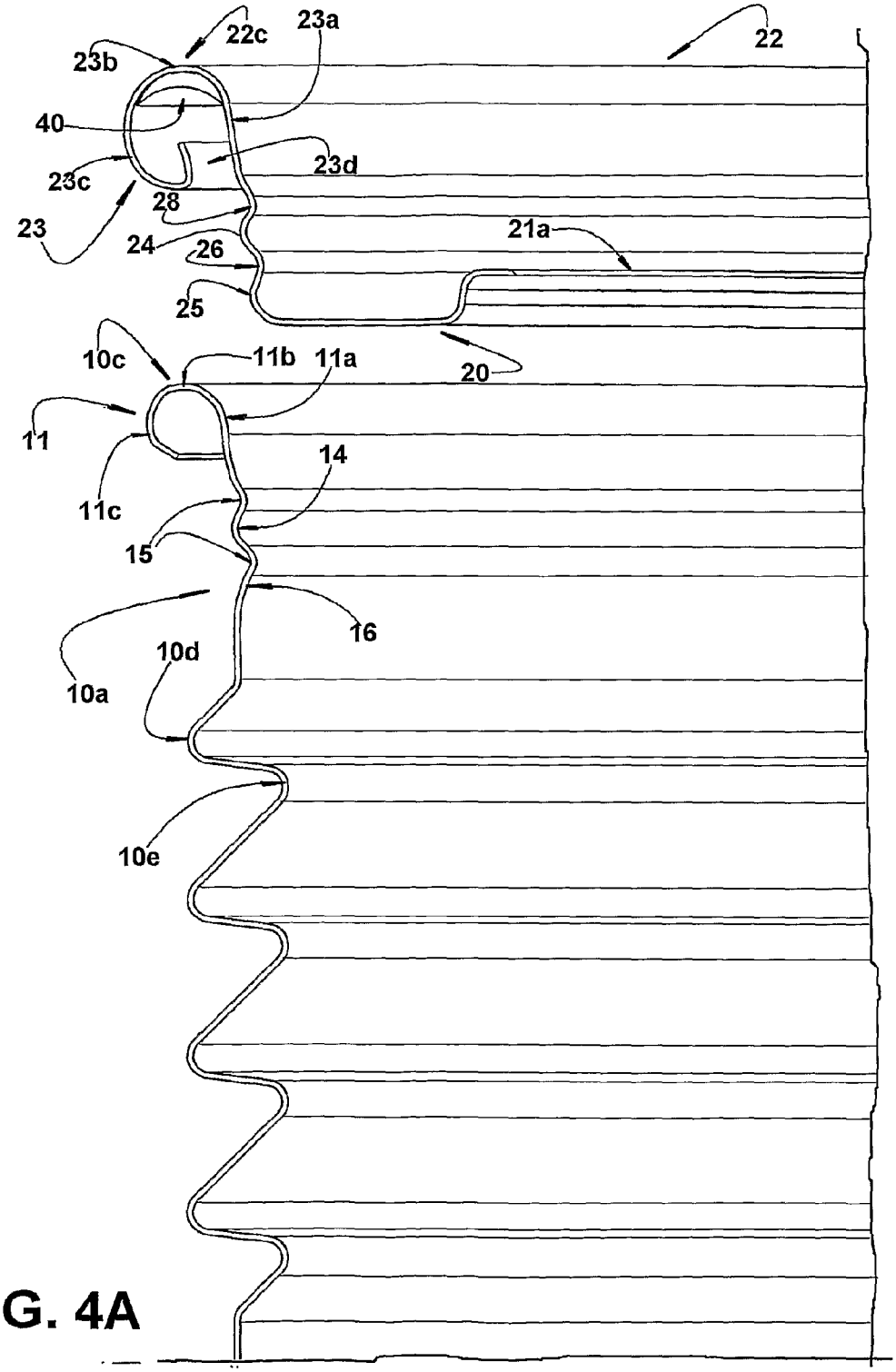
FIGS. 4A, 4B and 4C represent views respectively similar to those of FIGS. 3A, 3B and 3C, but illustrating a second embodiment of the invention, according to which the upper end portion of the peripheral side wall and the peripheral upper skirt of the upper end wall are also locked to each other by the mutual groove-rib engagement provided in said parts.
Figure 5A:
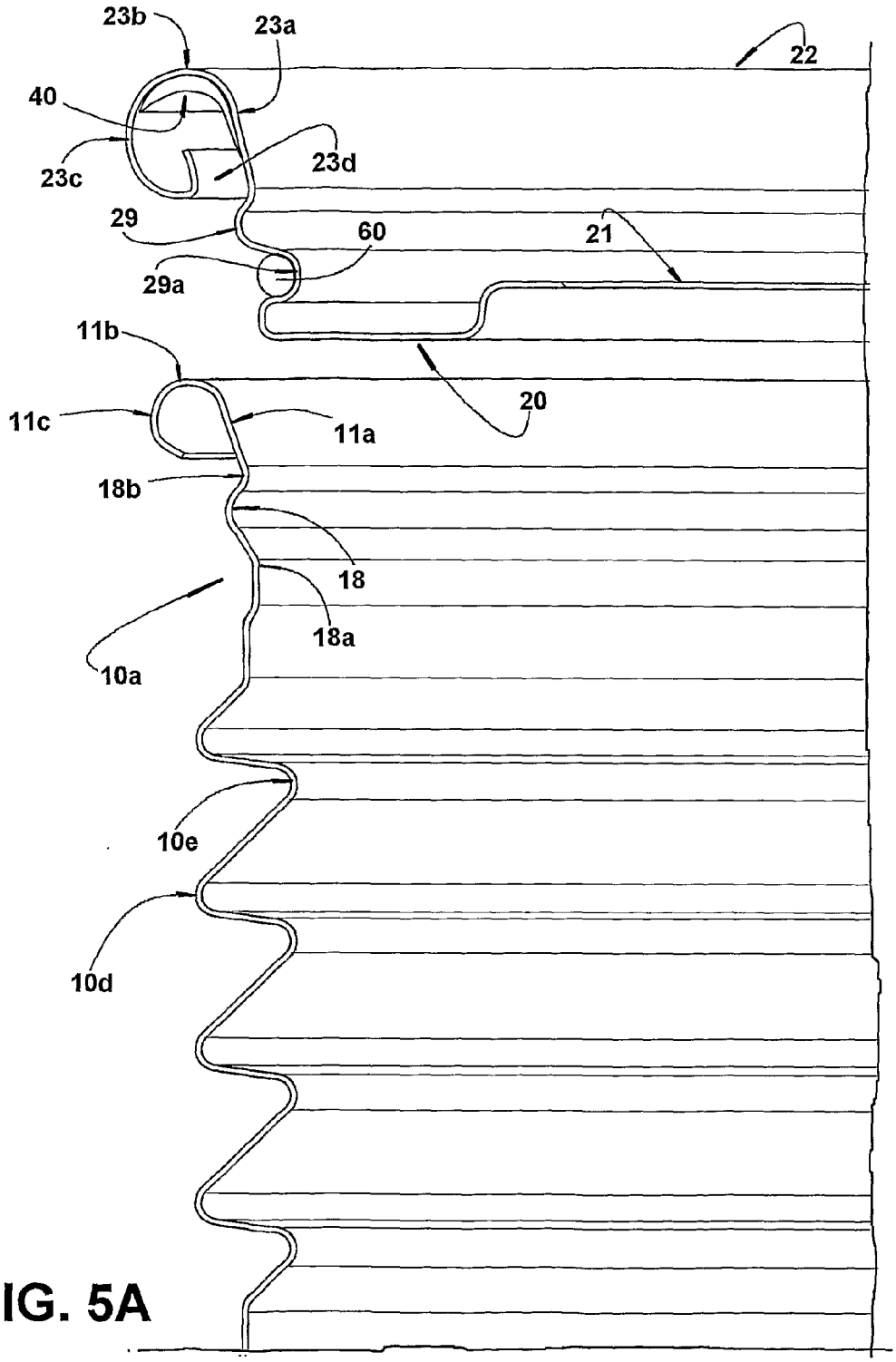
FIGS. 5A, 5B and 5C represent views respectively similar to those of FIGS. 4A, 4B and 4C, but illustrating a third embodiment of the invention, according to which the groove-rib locking between the peripheral side wall and the upper end wall is further provided with an elastic sealing ring.

According to a first embodiment of the invention, illustrated in FIGS. 2, 3A, 3B and 3C and which is maintained in the other embodiments, the upper end portion 10*a* has a peripheral edge 10*c* which is outwardly and downwardly bent in order to define a retention hook 11 with a profile in the approximate form of an inverted U, having an inner lateral leg 11*a* defined by part of the upper end portion 10*a*, an arched base leg 11*b* and an outer lateral leg 11*c* which, initially, does not need to be convergent in relation to the inner lateral leg 11, as illustrated in FIGS. 3A, 4A and 5A, which illustrate the bent peripheral edge 10*c* in a first stage, configured to allow only the provisional seating and retention of the upper end wall 20. In this first stage, the retention hook 11 also presents a slightly opened profile.

On the other hand, the upper end wall 20 is configured to have its peripheral upper skirt 22 fitted and seated in the interior of the upper end portion 10*a* and provided with an end edge 22*c* which is outwardly, downwardly and inwardly bent so as to define a closure hook 23 with a profile in the form of an inverted U, having an inner side portion 23*a* defined by an upper part of the peripheral upper skirt 22, an arched base portion 23*b* and an outer side portion 23*c* which, before seating the upper end wall 20 onto the peripheral side wall 10, presents an inwardly bent profile, but spaced from the inner side portion 23*a*.

The outer side portion 23*c* incorporates, internally, an end flange 23*d* which projects upwardly and inclined in an upward and outward manner.

The exploded views 3A, 4A and 5A illustrate the form imparted to the parts before closing the container. In this stage, the diameter of the free end edge of the outer lateral leg 11*c* is smaller than the diameter of the free upper edge of the end flange 23*d*, whereby, upon seating the upper end wall 20 in the condition illustrated in FIGS. 3B, 4B and 5B, both said parts suffer an elastic deformation, allowing the end flange 23*d* to be fitted under the free end edge of the outer lateral leg 11*c* of the retention hook 11.

Before seating the upper end wall 20 onto the peripheral side wall 10, it is applied or otherwise aggregated an elastic sealing element 40 internally to the base portion 23*b* of the closure hook 23, or externally to the base leg 11*b* of the retention hook 11. This elastic sealing element 40 can be defined, for example, by a plastisol gasket extended over part of the inner side portion 23*a* of the closure hook 23 or over part of the inner lateral leg 11*a* of the retention hook 11.

Being the container ready to be closed, after having already received, preferably before the previous seating and retention of the upper end wall 20, the product to be packaged, the retention hook 11 and the closure hook 23 can be thus submitted to a radial compression, to be carried out by any known annular device for this type of radial deformation in circular bodies, which device is not illustrated herein since it does not form part of the present invention.

The deformation imparted to the retention hook 11 and to the closure hook 23 produces a "seaming" of the closure hook 23 onto the retention hook 11, compressing the elastic sealing element 40 between the base leg 11*b* of the retention hook 11 and the base portion 23*b* of the closure hook 23. It is possible for the elastic sealing element 40 to present a part of its extension penetrating and being compressed between the inner lateral leg 11*a* of the retention hook 11 and the inner side portion 23*a* of the closure hook 23.

Figure 4B:
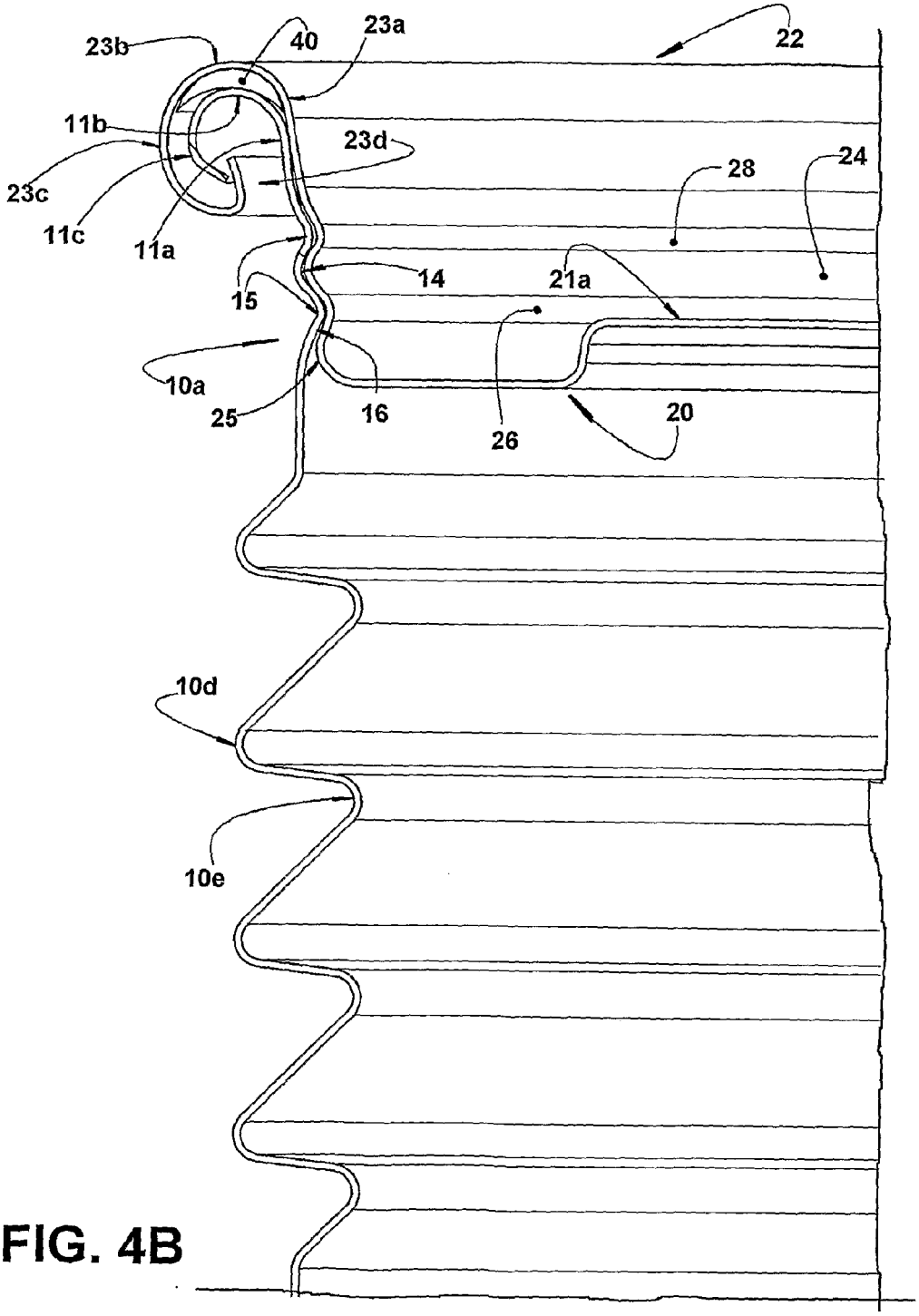
Figure 4C:
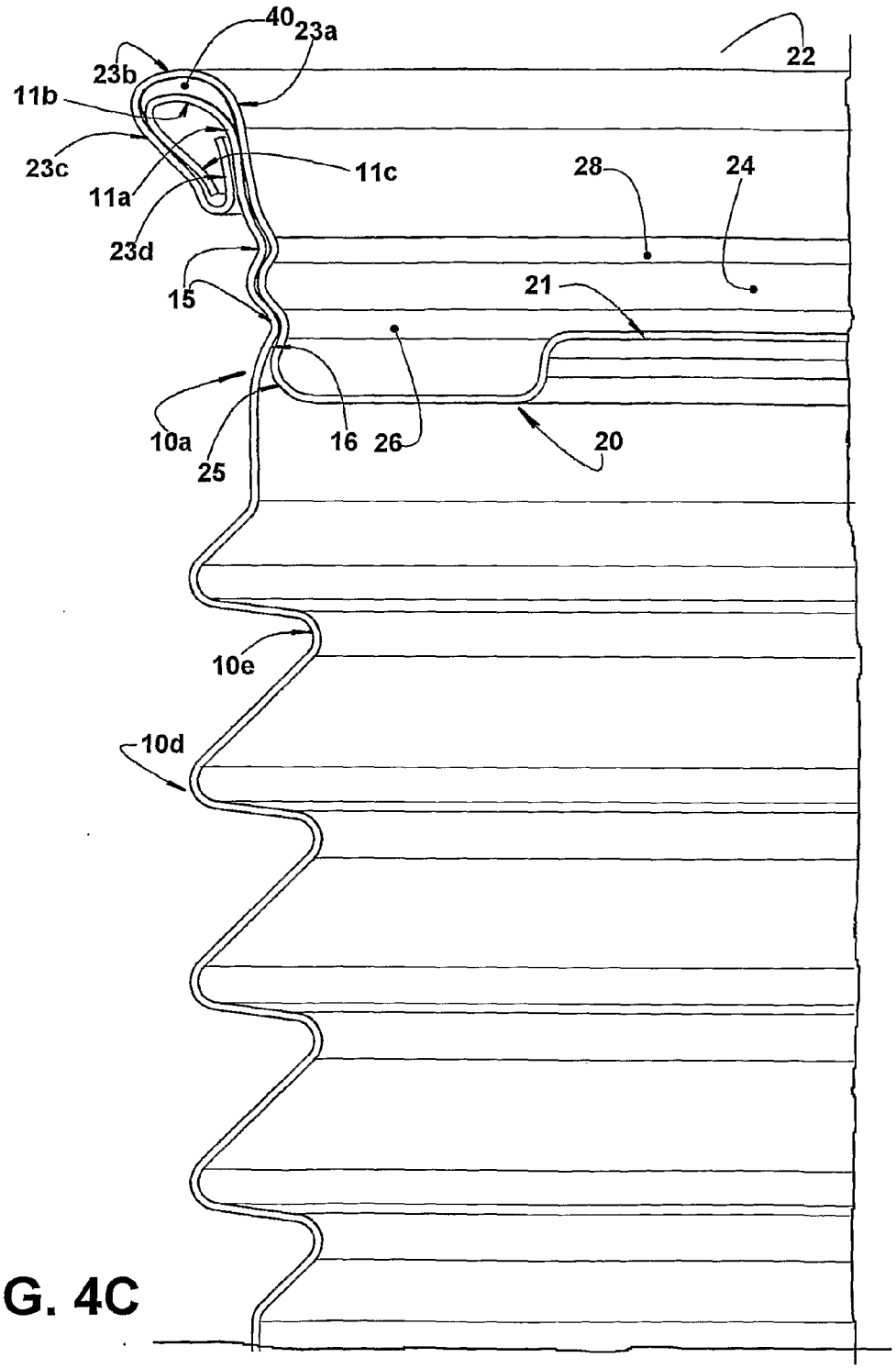
Figure 5B:
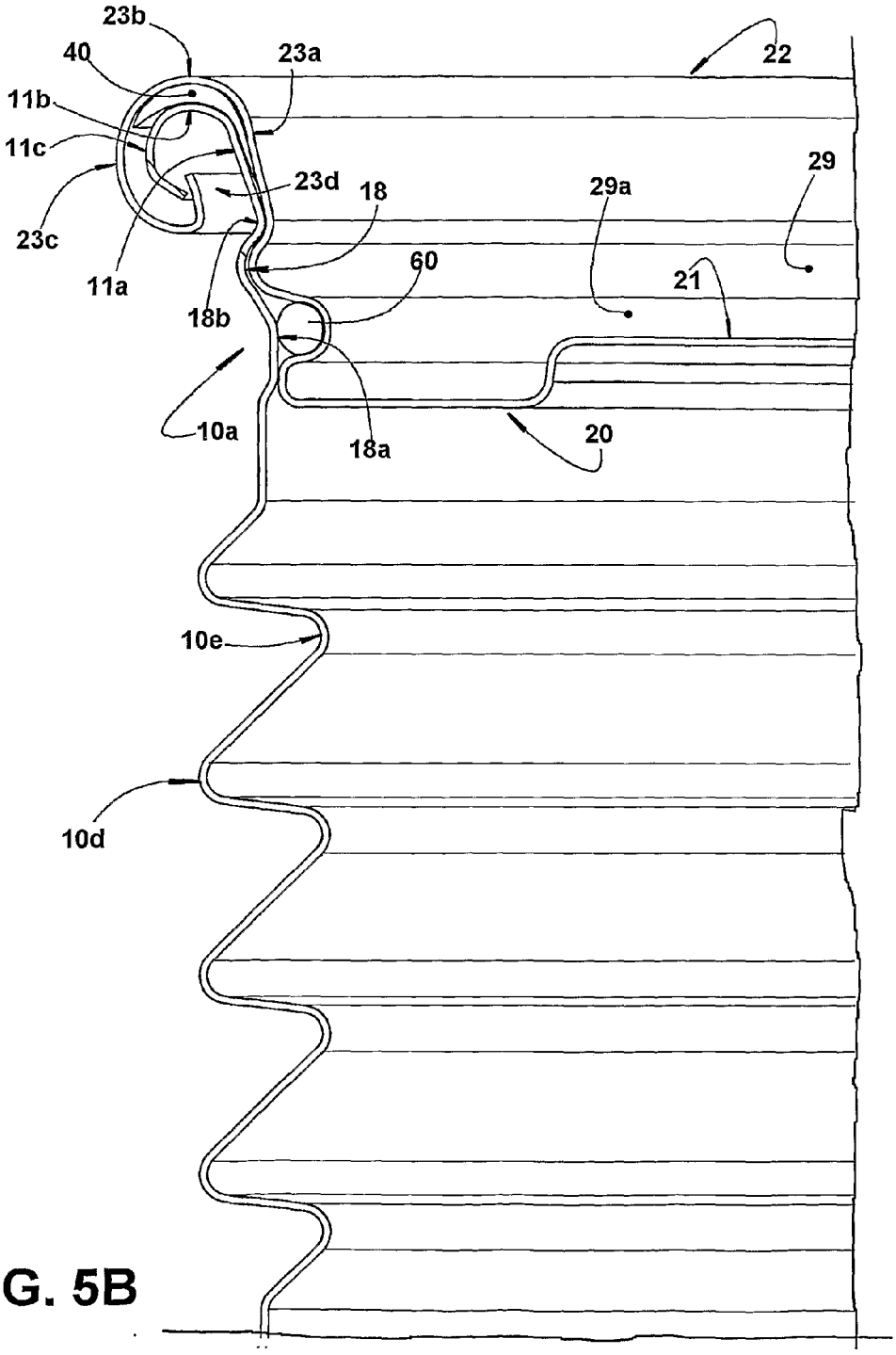
Figure 5C:
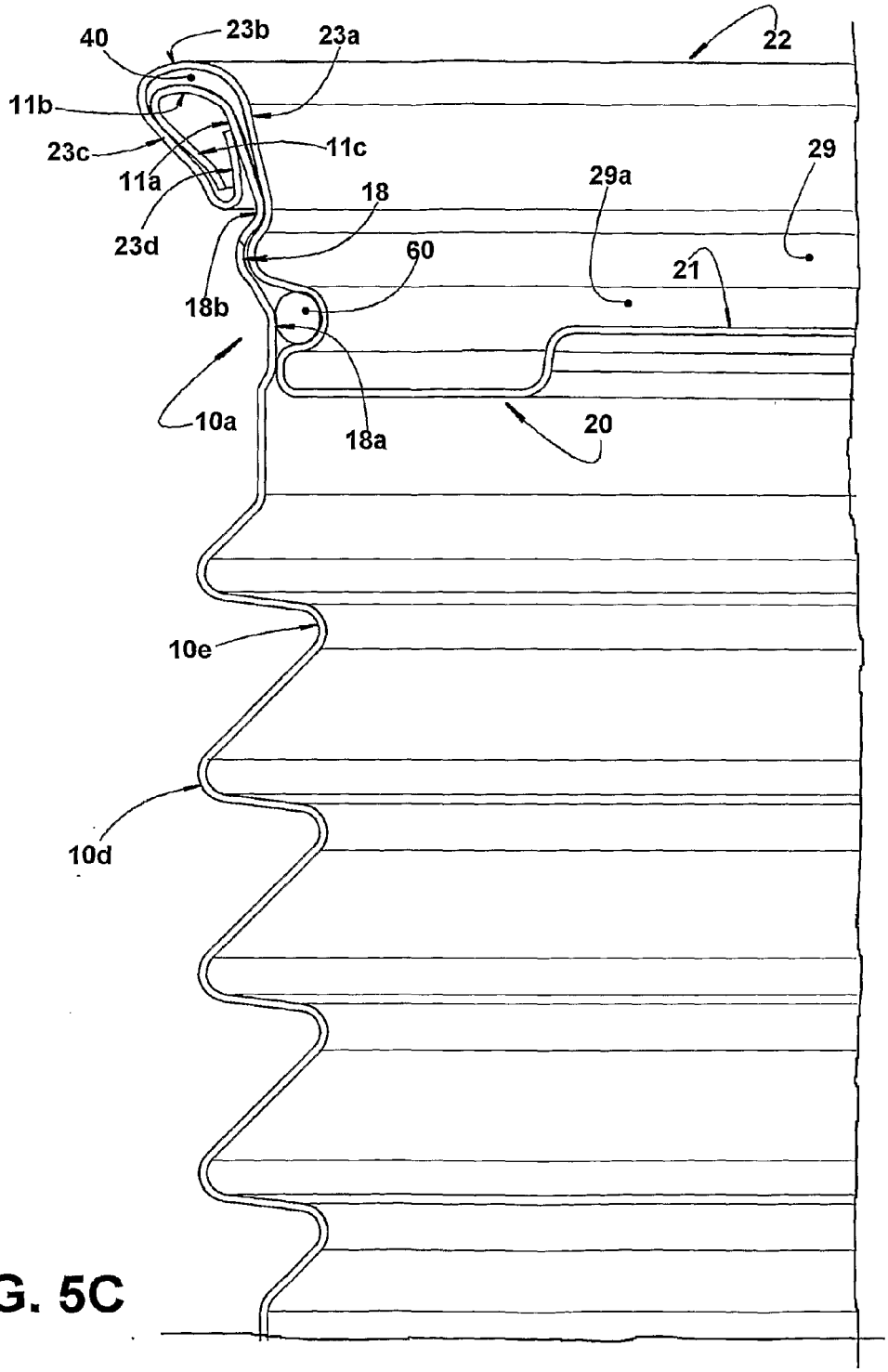

As illustrated in FIGS. 3C, 4C and 5C, after the radial compression of the two hooks 11 and 23, the inner side portion 23*a*, the arched base portion 23*b* and the outer side portion 23*c* of the closure hook 23 are internally and respectively seated against the inner side leg 11*a*, the arched base leg 11*b* and the outer lateral leg 11*c* of the retention hook 11, with the end flange 23*d* projecting upwardly to the interior of the retention hook 11, between the outer side portion 23*c* and the inner side portion 23*a* of the latter.

Further as illustrated, after finishing the deformation of both the retention hook 11 and the closure hook 23, the outer lateral leg 11*c* of the retention hook 11 and the outer side portion 23*c* of the closure hook 23 assume a substantially straight and downwardly and radially inwardly inclined profile, guaranteeing a strong, reliable and tight fixation of the upper end wall 20 to the peripheral side wall 10.

With the purpose of facilitating the accommodation of the two parts to be fixed to each other, as well as the operations of plastic deformation of the metal sheet during the initial and final formation of the two hooks, the inner lateral leg 11*a* and the inner side portion 23*a* of the retention hook 11 and the closure hook 23, respectively, are initially conformed to present an inclined profile that is substantially rectilinear and slightly inclined upwardly and radially outwardly.

Considering that the construction of the present container aims at obtaining a closure which is easily executed, but sufficiently resistant to comply with the safety requirements imposed to the containers of dangerous products, the peripheral side wall can be provided with energy absorbing means by controlled plastic deformation. Thus, the peripheral side wall 10 can present two regions respectively adjacent to the upper end portion 10*a* and lower end portion 10*b*, each occupying about 10% to 15% of the height of the peripheral side wall 10 and conformed in a plurality of circumferential ribs 10*d* and grooves 10*e* presenting a profile in the form of a laid V with a rounded apex. These regions present a pleated structure which tends to be deformed before an undue deformation of the container occurs in the regions in which the end walls 20, 30 are affixed to the peripheral side wall 10.

As better observed in FIGS. 1 and 2, considering that the two end walls 20 and 30 are definitively affixed to the peripheral side wall 10, the median panel 21 of the upper end wall 20 is provided with a generally eccentric opening 21*a* of smaller diameter, and with a gripping handle 50 generally positioned in the central region of said upper end wall 20, the gripping handle 50 being integrally affixed in said upper end wall 20, so as to allow the container, even if filled, to be lifted by said gripping handle 50. In this type of construction, the smaller diameter opening 21*a* is usually closed by a removable lid, preferably constructed in a plastic material and which is not illustrated herein, as it forms no part of the present invention.

FIGS. 4A, 4B and 4C illustrate a second embodiment for the present container, including, besides the peripheral upper seaming described insofar, an additional axial retention of the upper end wall 20.

According to said second embodiment, which can be applied to all the characteristics described up to now, one of the parts defined by the peripheral upper skirt 22 of the upper end wall 20 and by the upper end portion 10*a* is provided with at least one circumferential retention rib 24 turned to the other of said parts. In the illustrated example, the retention rib 24 is externally provided in the peripheral upper skirt 22 of the upper end wall 20. The other part, exemplarily defined by the upper end portion 10*a* of the peripheral side wall 10, is provided with a circumferential retention groove 14 defined between two face portions 15 and conformed to be fitted onto the retention rib 24, upon the fitting of the upper end wall 20 in the interior of the upper end portion 10*a* of the peripheral side wall 10 and upon the seating of the face portions 15 of the upper end portion 10*a* against the peripheral upper skirt 22.

In the illustrated construction, the retention rib and the retention groove (24,14) are formed by deforming the metal sheet of the respective parts and present a cross section with the approximate form of a rounded V, formed in convex and concave arcs, respectively. This constructive form facilitates the fitting of the upper end wall 20 in the interior of the upper end portion 10*a*, simultaneously providing the necessary degree of mechanical interference between the rib and the groove, so as to aid in the axial retention of the upper end wall 20.

In the illustrated construction, one of the parts defined by the upper end portion 10*a* of the peripheral side wall 10 and by the peripheral upper skirt 22 of the upper end wall 20, in this case the peripheral upper skirt 22 being externally provided with two (or more) axially spaced retention ribs 24,25 forming, therebetween, an intermediary face portion 26 in said skirt part. The axially outermost retention rib 24 is fitted into a respective retention groove 14 internally formed in the other part, which is exemplarily defined herein by the upper outer portion 10*a*, upon seating the intermediary face portion 26 of the peripheral upper skirt 22 against a confronting face portion 15 of the other part defined by the upper end portion 10*a*. The axially innermost circumferential rib 25 of the peripheral upper skirt 22 is configured to be seated against a retention portion 16 of the other part defined by the upper end portion 10*a*, axially locking the upper end wall 20 to the peripheral side wall 10.

In the illustrated constructive form, the axially innermost face portion 15 of the upper end portion 10*a* presents an internally convex arched profile, to be seated against the intermediary face portion 26, of the peripheral upper skirt 22, presenting an externally concave arched profile. On the other hand, the axially outermost face portion 15 presents an internally convex arched profile, to be seated against an end face portion 28, in an externally concave arched profile, of the peripheral upper skirt 22.

Although the illustrated construction presents two circumferential ribs 24, 25 in the peripheral upper skirt 22 of the upper end wall 20 and a circumferential groove 14 in the upper end portion 10*a* of the peripheral side wall 10, it should be understood that the number of circumferential ribs 24, 25 can be even greater.

It should be further observed that the circumferential ribs 24, 25 can be provided in the upper end portion 10*a* of the peripheral side wall 10, with the circumferential groove 14 being provided in the peripheral upper skirt 22 of the upper end wall 20. It should be also noted that both the circumferential groove and the circumferential ribs can be provided in both parts defined by the peripheral upper skirt 22 and by the upper end portion 10*a* of the peripheral side wall 10, although the illustrated embodiment provides two circumferential ribs 24, 25 radially projecting in the same direction in the peripheral upper skirt 22 of the upper end wall 20.

Considering that the container is formed in metal sheet, both the circumferential ribs 24, 25 and the circumferential groove 14 are preferably obtained by deforming the metal sheet of the respective parts of the container.

FIGS. 5A, 5B and 5C, illustrate a third embodiment for the present container, including, besides the peripheral upper seaming previously described, an additional axial retention and an additional sealing of the upper end wall 20.

According to this third embodiment, the upper end portion 10*a* of the peripheral side wall 10 internally presents a circumferential recess 18, with the profile in the form of a laid V, having the apex rounded in a convex arc and the sides coincident with the peripheral side wall 10 of the container.

It should be understood that the circumferential recess 18 can present other profiles besides the one illustrated herein, such as a profile with a triangular cross section, and, for example, constituted by a plurality of portions of circumferential recess 18 distributed along one or more planes orthogonal to the axis of the container, each actuating against a respective region of the peripheral upper skirt 22, so as to lock the latter against the container.

According to said third embodiment, the peripheral upper skirt 22 of the upper end wall 20 is externally provided with a circumferential rib 29 configured to be partially or totally fitted in the circumferential recess 18 of the upper end portion 10*a*, and with a circumferential groove 29*a* positioned inferiorly to the circumferential rib 29 and configured to house an elastic sealing ring 60, for example in elastomer, which is kept seated against a generally cylindrical sealing portion 18*a*, of the peripheral side wall 10, defined beneath the circumferential recess 18 of the latter, the circumferential groove 29*a* being conformed to maintain the elastic sealing ring 60 radially spaced back in relation to the circumferential rib 29.

According to the drawings, the circumferential rib 29 presents a profile in the form of a laid V, having the apex rounded in a convex arc and the sides coincident with the peripheral upper skirt 22, allowing defining a circumferential step external to said skirt, without producing any cutting edge in the outer surface of the latter. In a similar manner, the circumferential groove 29*a* presents a profile in the form of a laid V, having the apex rounded in a convex arc and the sides coincident with the peripheral upper skirt 22.

In the illustrated construction, the sealing portion 18*a* of the peripheral side wall 10 is defined by an axial extension of the latter, presenting an inner diameter inferior to the smallest diameter of a retention portion 18*b* of the peripheral side wall 10 defined between said sealing portion 18*a* and the peripheral edge 10*c* of the upper end portion 10*a*, allowing the elastic sealing ring 60, slightly projecting from the circumferential groove 29*a*, to be compressed against said sealing portion 18*a*, in order to guarantee tightness to the closure of the container, without said elastic sealing ring 60 contacting the peripheral edge 10*c* of the upper end portion 10*a*, as well as the retention portion 18*b* during the mounting axial displacement of the upper end wall.

The sealing portion 18*a* of the peripheral side wall 10 presents an inner diameter inferior to the inner diameter of the extension of the peripheral side wall 10 disposed immediately beneath.

The positioning of the elastic sealing ring 60 prevents degradation of the inner protecting varnish and of the respective metal sheet regions, in said region of mutual metal-metal friction between the peripheral upper skirt 22 and the peripheral side wall 10 of the container, from contaminating and deteriorating the packaged product.

Figure 6:
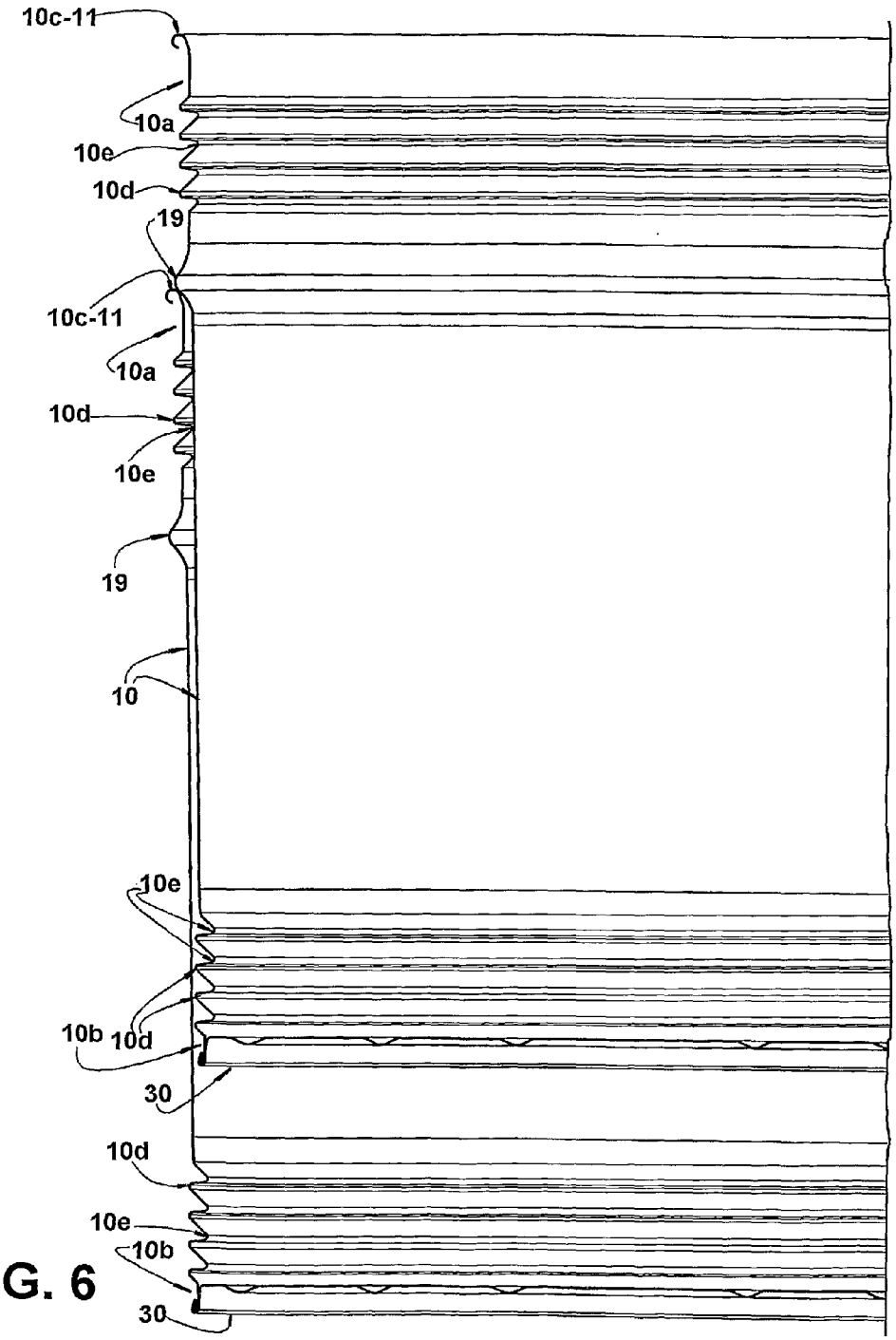
FIG. 6 represents a partial diametrical sectional view of two containers constructed according to the first embodiment and deprived of the upper end wall and partially fitted one into the other.

As already previously mentioned and as illustrated in FIG. 6 of the enclosed drawings, the peripheral side wall 10 of the container can be constructed to allow the partial telescopic fitting between two stacked containers. In the illustrated embodiment, the peripheral side wall 10 has an inverted and slightly frusto-conical form, the smaller base coinciding with the lower end wall 30 and the larger base being preferably situated in a plane axially spaced back in relation to the mounting plane of the upper end wall 20 and in which the peripheral side wall 10 is deformed to define an outer circumferential projection 19.

With this construction, a container can be telescopically fitted inside another inferiorly disposed container deprived of the upper end wall, this fitting, illustrated in FIG. 6, being carried out until the outer circumferential projection 19 is seated onto the free edge of the upper end portion 10*a* of the peripheral side wall 10, allowing the thus stacked containers to occupy a total volume substantially inferior to the volume that would be occupied with the same number of inferiorly and superiorly closed containers stacked one on top of the other. With this partial fitting arrangement, the containers can be stored and shipped with a great economy in volume and, accordingly, in cost.

While only one embodiment of the invention has been illustrated herein, it should be understood that the present closure arrangement can suffer alterations in the form and physical arrangement of its component parts, without departing from the constructive concept defined in the claims that accompany the present specification.

The invention claimed is:

1. A container in metal sheet, comprising a peripheral side wall having an upper end portion and a lower end portion, to which respective upper end wall and lower end wall are affixed, the upper end portion having a peripheral edge which is outwardly and downwardly bent so as to define a retention hook with a profile in the form of an inverted U, having an inner lateral leg defined by part of the upper end portion, an arched base leg, and an outer lateral leg converging in relation to the inner lateral leg, the upper end wall comprising a median panel and a peripheral upper skirt fitted and seated in the interior of the upper end portion and having an end edge which is outwardly, downwardly and inwardly bent so as to define a closure hook with a profile in the form of an inverted U, having an inner side portion defined by the upper part of the peripheral upper skirt, an arched base portion, and an outer side portion converging in relation to the inner side portion and incorporating, internally, an end flange projecting upwardly, the inner side portion, the arched base portion and the outer side portion of the closure hook being internally and respectively seated against the inner side leg, the arched base leg and the outer lateral leg of the retention hook, with the end flange projecting upwardly to the interior of the retention hook, between the outer side portion and the inner side portion of the latter, and with the arched base leg and the arched base portion compressing an elastic sealing element therebetween;

the outer lateral leg and the outer side portion of the retention hook and of the closure hook are, respectively, substantially rectilinear and inclined downwardly and radially inwardly;

the inner lateral leg and the inner side portion of the retention hook and the closure hook are substantially rectilinear and slightly inclined upwardly and radially outwardly, wherein the closure hook projects upwardly and outwardly and terminates in an upward and outward configuration.

2. The container, as set forth in claim 1, characterized in that the outer lateral leg and the outer side portion of the retention hook and of the closure hook are, respectively, substantially rectilinear and inclined downwardly and radially inwardly.

3. The container, as set forth in claim 1, characterized in that the inner lateral leg and the inner side portion of the retention hook and the closure hook are substantially rectilinear and slightly inclined upwardly and radially outwardly.

4. The container, as set forth in claim 1, characterized in that the elastic sealing element has a portion of its extension penetrating and being compressed between the inner lateral leg and the inner side portion of the retention hook and of the closure hook, respectively.

5. The container, as set forth in claim 1, characterized in that the peripheral side wall presents two regions respectively adjacent to the upper end portion and lower end portion, each occupying about 10% to 15% of the height of the peripheral side wall and being conformed in a plurality of circumferential ribs and circumferential grooves, with the profile in the form of a laid V with a rounded apex.

6. The container, as set forth in claim 1, characterized in that the median panel of the upper end wall is provided with a smaller diameter opening and with a gripping handle.

* * * * *